United States Patent [19]

Yonezawa

[11] 4,085,669

[45] Apr. 25, 1978

[54] OVERLOAD PROTECTOR FOR MECHANICAL PRESS

[75] Inventor: Keitaro Yonezawa, Kobe, Japan

[73] Assignee: Aioi Seiki Kabushiki Kaisha

[21] Appl. No.: 680,731

[22] Filed: Apr. 27, 1976

[30] Foreign Application Priority Data

May 15, 1975 Japan ..... 50-58055
Dec. 12, 1975 Japan ..... 50-152099

[51] Int. Cl.[2] ..... B30B 15/28
[52] U.S. Cl. ..... 100/53; 192/150
[58] Field of Search ..... 100/53, 269; 192/150; 425/150; 72/26

[56] References Cited

U.S. PATENT DOCUMENTS 3,426,873 2/1969 Tezuka ..... 100/53 X
3,955,396 5/1976 Carrieri ..... 100/53

*Primary Examiner*—Peter Feldman
*Attorney, Agent, or Firm*—Bacon & Thomas

[57] ABSTRACT

An overload protector for mechanical press comprises a cylinder chamber formed in the mechanical actuating chain of the press, and filled with incompressible fluid; a safety valve which relieves the fluid from the chamber when the chain receives an overload, and which includes a relief route containing a pilot valve part and main valve part in series. The pilot valve part is arranged to close the route at the outlet of the passage penetrating the valve member of the main valve part therethrough, and to be opened by the pressure of the fluid when above the setting pressure for relief. The valve member of the main valve part is arranged to be moved for opening the route by the difference between the pressures acting thereon from both sides connected by the passage when the pilot valve part is opened.

4 Claims, 8 Drawing Figures

OVERLOAD PROTECTOR FOR MECHANICAL PRESS

BACKGROUND OF THE INVENTION

The present invention relates to an overload protector for a mechanical press, in particular, which comprises a cylinder chamber formed in the mechanical actuating chain of the press for incompressible fluid, and a safety valve which relieves the fluid from the chamber for permitting some members of the chain to move relative to the others when the chain meets an overload.

DESCRIPTION OF THE PRIOR ART

An overload protector for a mechanical press comprising a cylinder chamber in the mechanical actuating member, such as slide, for filling with incompressible fluid that is generally hydraulic fluid supplied from a hydraulic power unit to transmit pressing power from the member, such as connecting rod of crank chain, to the member aforementioned; and a safety valve which relieves the fluid from the chamber when the chain receives an overload is known. And the safety valve is comprised of a direct operated relief valve or pilot operated relief valve or pilot operated relief valve of a conventional type.

However, the conventional direct operated relief valve is subject to chattering of the valve member.

The conventional pilot operated relief valve comprises a needle valve as the pilot valve, a narrow orifice penetrating a piston formed in a body with the main valve member, a pilot operating fluid passage including the orifice, which is provided in the valve case parallel with the main passage controlled by the main valve. In this arrangement, the structure of the valve is comparatively complex, and moreover, the response to a shock overload is often insufficient because of the delay of effective actuation of the valve. The pilot valve is delayed by the concussion effect of the orifice; the valve member of the main valve by the heavy inertia or itself united with the piston.

SUMMARY OF THE INVENTION

Accordingly it is the first object of the present invention to remedy these disadvantages mentioned above, and to provide a new and improved overload protector for a mechanical press which responds effectively to any shock overload.

In order to implement these and still further objects of the invention which will become more apparent as the description proceeds, the overload protector comprises a cylinder chamber formed in the mechanical actuating chain of the press, and filled with incompressible fluid; a safety valve which relieves the fluid from the chamber, and which includes a pilot valve part, a main valve part, and a relief route containing the two valve parts in series: The valve member of the main valve part, provided with a passage which forms a part of the route therethrough, is arranged to be moved by the difference between the pressures acting thereon from both sides connected with the passage for opening the route; the pilot valve part closes the passage at the outlet normally, and is opened by the abnormal high pressure of the fluid which acts thereon from the passage when the press meets a shock overload. As the passage is large enough to relieve the fluid, the inertia of the valve member of the main valve part (main valve member) is smaller than that of the conventional one, and the rise of pressure is transmitted quickly and accurately from the chamber to the pilot valve part through the passage without concussion by orifice.

The further object of the invention is to ensure quick and accurate actuation of the pilot valve part for the creation and growth of the differential pressure which will act on the main valve member.

In order to implement this object, the pilot valve part preferably comprises a poppet formed around the outlet of a passage which penetrates the main valve member, and a complementary valve seat, and means for setting the cracking pressure of the pilot valve part; the means which push the valve seat toward the complementary poppet.

Another object of the invention is to make a safety valve responsive for a slow rise of the fluid pressure from the setting pressure for pressure-temperature compensation.

In order to implement this object, the safety valve preferably comprises a pilot operated relief valve part which is arranged in the same manner as the safety valve described above; and a pressure-temperature compensation valve part associated in a body parallel with the former part. The structure of the association of the two parts is preferably comprised to be that described hereinafter: The member provided with the first valve seat on one side, is provided with the second valve seat on the opposite side from the first one; the first one for the pilot valve of the relief valve part, the second for the compensation valve part. And the member is also provided with an orifice which connects the passages through both valve seats. The poppet cooperating with the second valve seat is pushed forward to the seat by means for setting the cracking pressure of the compensation valve part, and of the pilot valve part. The latter pressure is comprised to be higher than the former by means of differential pressure acting on the member. Namely, the diameter of the poppet for the pilot valve is smaller than that of the poppet for the compensation valve to bring about the difference between the pressures acting on the member from both sides. Thus, the poppet of the compensation valve part is lifted to crack with lower pressure set, for relief of the fluid therethrough, than the setting pressure of the relief valve part.

The structure mentioned hereinabove is advantageous in that the structure is simpler than that of mere connection of the two valve parts, i.e., the relief valve part and the compensation valve part in parallel; and moreover, that the setting maneuver of the relief pressures, of the cracking pressures for both relief valve part and compensation valve part is easier than that required for the conventional one. Because, according to the diameters of the two poppets, the setting pressure for the relief valve part is relative to the setting pressure for compensation valve part, and the setting of the latter by the means for setting of relief pressure brings about the setting of the former due to the differential pressure acting on the member. It would be needless to say that the valve described herein is effective to relieve the fluid from the chamber through the relief valve part for a shock or sudden rise of the pressure, and through the compensation valve part for a slow rise of the pressure.

BRIEF DESCRIPTION OF THE DRAWINGS

The invention will be better understood and objects other than set forth above, will become apparent, when consideration is given to the following detailed description thereof. Such description makes reference to the annexed drawings wherein.

DETAILED DESCRIPTION OF THE PREFERRED EMBODIMENTS

Figure 1:
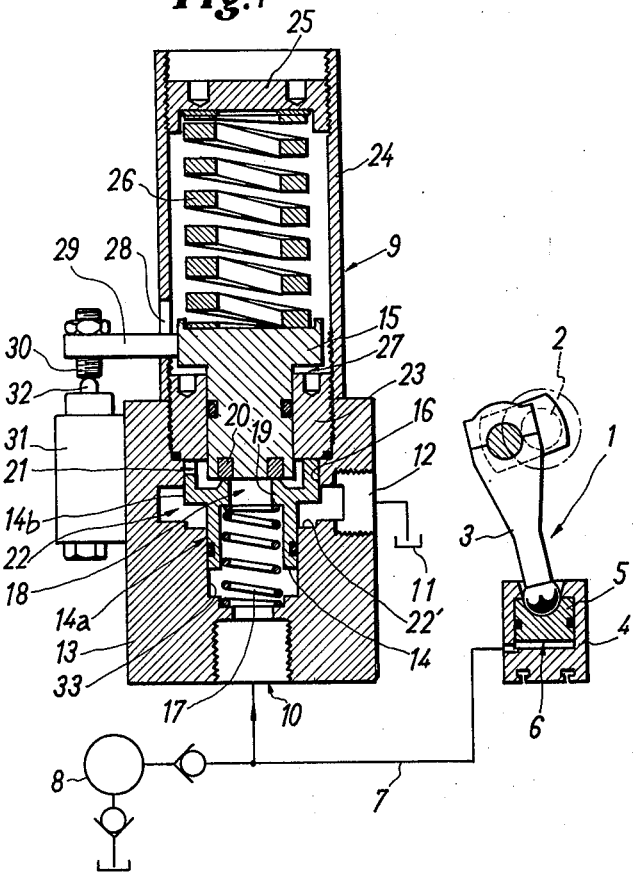
FIG. 1 is a vertical sectional view through an overload protector under the normal pressure condition.

Now, referring to FIG. 1, a crank chain of a crank press, designated as 1, is arranged to convert the revolution of the crankshaft 2 into vertical linear motion of the slide 4 by way of connecting rod 3. A cylinder chamber 6 is formed in the slide 4, and a piston 5 connected to the rod 3 is inserted in the chamber 6. The chamber 6 is filled with hydraulic fluid supplied from a hydraulic power unit 8 by hydraulic passage 7 for transmitting mechanical power from the crank chain 1 to the slide 4. When the load is over a determined value for the slide 4, the pressure of the fluid in the chamber rises above the setting pressure of a safety valve connected to the hydraulic passage. Consequently, the fluid in the chamber is pushed out to the hydraulic passage by the relief of the fluid through the safety valve, and the slide 4 is permitted to move relative to the crank chain 1 by the stroke of the piston 5 for the protection of the mechanical actuating chain of the press from overloading.

The present invention is equipped with a safety valve for the relief of the fluid from the chamber, which is connected to the hydraulic passage and arranged as follows:

The safety valve 9 has an inlet port 10 which is connected to the hydraulic passage 7, and an outlet port 12 which is connected to a tank 11, both in the valve case 13. A main valve member 14 is inserted in the valve chamber 22 formed in the case 13, and is provided with a vertical passage 18 through its center. The inlet of the passage 18 is connected to the inlet port 10 directly. A poppet 19 is formed around the outlet of the passage 18 on the main valve member 14. The poppet is arranged to be closed against a valve seat 20 provided at the bottom of a member 15 which is inserted in the valve chamber 22 to travel vertically over the main valve member 14. The means for setting of relief pressure, designated as 26, is a spring.

The main valve member 14 includes a cylindrical part of small diameter 14a at its lower part, and another cylindrical part of large diameter 14b at its upper part. Each cylindrical part is fitted in guide hole 33, 16, and the member 14 is able to slide vertically in these holes. As is apparent, these cylindrical parts and holes are all coaxial.

The main valve member 14 is urged upwardly by a spring 17 positioned in the smaller cylindrical part 14a, toward member 15. The upward movement of the main valve member 14 is limited by a stop 23 screwed in the valve case 13.

A plurality of cuts 21 is provided on the circumference of the larger cylindrical part 14b of the main valve member. And these cuts 21 are exposed in the valve chamber 22 when the valve member 14 is moved downwardly against the spring 17.

The second member 15 is able to slide vertically in the hole provided through the stop 23. And the descent of the member 15 is limited by the stop 23 and a radial projection provided around the higher part of the member 15.

A cylindrical case 24 is screwed on the stop 15, providing an adjustable seat 25 for the spring 26. The spring 26 is held between the seat 25 and the top of the second member 15 in the cylindrical case 24.

A space 27 is provided for the descent of the second member. An arm 29 projects from a second member 15 through the opening 28 in the cylindrical case 24. The opening 28 is provided on the circumference of the case 24 and the arm extends to the outside of the case and is provided with a bolt 30 for pushing the pusher 32 of a limit switch 31. The limit switch 31 is effective to stop the actuation of the press and the hydraulic power unit 8 when the pusher is pushed downward by the arm 29.

The actuation of the safety valve will be described hereinafter.

Under the normal actuation of the press concerned, the valve seat 20 is held against the complementary poppet 19 formed on the main valve member 14 by means of the pressure of the spring 26; and the main valve member 14 is elevated in the guide hole 16 by means of the pressure of the spring 17 and fluid, as shown in FIG. 1.

When an overload is imposed on the slide 4, the pressure of the fluid in the chamber 6 rises abnormally. This abnormal rise of the pressure is transmitted directly to the inlet port 10 of the safety valve 9 by way of the hydraulic passage 7.

Figure 2:
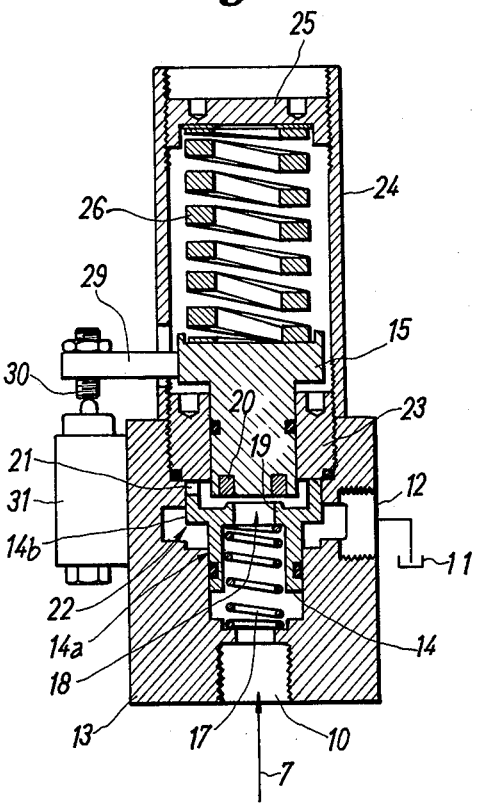
FIG. 2 is a vertical sectional view of the safety valve of the same overload protector at the beginning of an overload condition.

The pressure transmitted thereto acts directly to the lower facet of the second member 15, and when the pressure transmitted rises above the cracking pressure of the pilot valve part comprising the valve seat 20 and the poppet 19, the second member 15 is lifted upward against the spring 26 slightly, as shown in FIG. 2. Thus, the pilot valve part is opened, and the fluid flows past the main valve member 14 through the passage 18.

The pilot valve is quickly and accurately opened because the passage 18 is sufficiently large to pass the fluid therethrough for relief, so that the pressure acting on the second member 15 is sufficiently strong, and offers less resistance to the transition of the pressure.

The pressure of the fluid then acts on the main valve member 14 from the top side and the bottom side at the same time. The effective area for receiving the pressure of fluid at the top is greater than that at the bottom.

Figure 3:
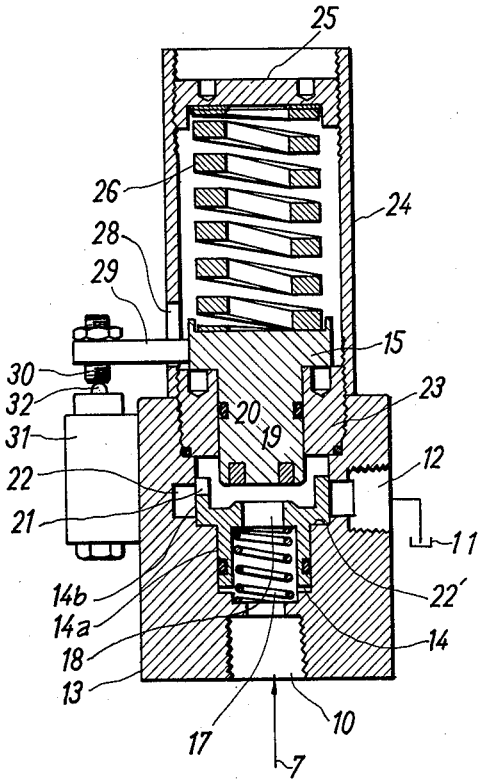
FIG. 3 is a vertical sectional view of the same safety valve showing relief actuation when the main valve part is opening.

Therefore, a differential pressure exists across the member 14 and forces it downwardly. When the member 14 is lowered, the cuts 21 formed on the circumference of the large cylindrical part 14*b* open into the valve chamber 22 and a relief route is established from the inlet port 10 by the passage 18, the cuts 21, and the valve chamber 22, to the outlet port 12 in the valve case 13. Once the relief route is established, the pressure of the fluid acting on the top of 14 is reduced suddenly. When the pressure acting on the top of 14 becomes euivalent to the opposing pressure, the descent of the main valve member 14 stops. In this condition the relief is still effective. FIG. 3 shows an extreme example in the relief actuation. In the normal relief operation, the valve member 14 descends to the bottom of the valve chamber 22. In the case shown in FIG. 3, the main valve member is cushioned by expelling the fluid from the recess 22' which is provided in the bottom of the valve chamber 22'.

The descent of the main valve member is quick. It is because the pilot operation is carried out by the poppet valve which contributes in the growth of the differential pressure with the described outflow of fluid and because of the small inertia of the member 14 resulting from the presence of the large passage 18 through it.

As the pressure of the fluid is reduced by the relief described, the slide 4 is able to rise relative to the crank chain 1, and overload is absorbed by that movement.

Figure 4:
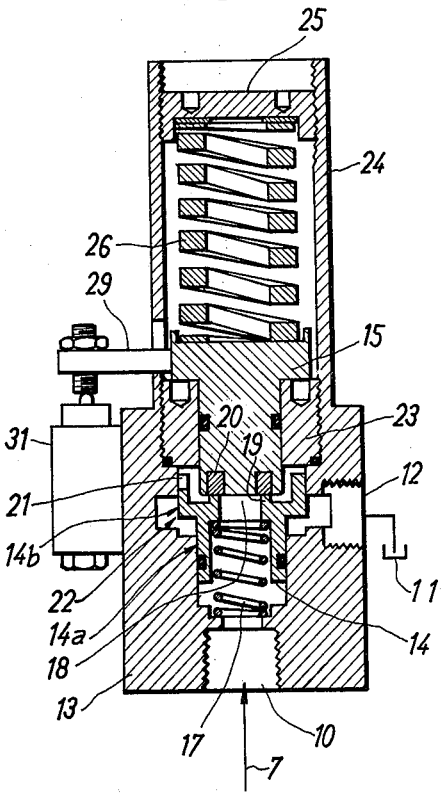
FIG. 4 is a vertical sectional view of the same valve at the end of relief actuation.

The reduction of the pressure at the top side of the main valve member 14 causes the spring 26 to push the second member 15 downward, as shown in the FIG. 4. And by the descent of the second member 15, the limit switch 31 is actuated to stop the press and the power unit 8. Therefore, once the second member 15 is lowered to the position shown in FIG. 4, the press and the power unit 8 are unable to operate unless a resetting maneuver is carried out. This fact is very advantageous in terms of safety.

Moreover, it is quite apparent that the process in the relief operation causes no chattering.

The time for carrying out the actuation which is shown in the FIG. 1–4 has been determined to be about from 0.03 to 0.1 seconds.

After the automatic stop of the equipment effected by the safety valve and the limit switch, and reset of the overload protector has been carried out, the operator may resume the operation of the press. The maneuver for reset for the resumption of the press operation may preferably be carried out by means of a resetting switch (not shown in the drawings). The steps of the maneuver may preferably be initiated with the starting of the power unit 8 to take up slack in the mechanical actuating chain. This first step will make the safety valve 9 to reset into the normal condition which is shown in FIG. 1.

In the embodiment desribed above, the limiting of overload to begin the relief of the fluid is set by means of setting of relief pressure. The setting is carried out by the adjustment of the means for setting of relief pressure, i.e., the spring 26 urging the second member 15 downward.

Figure 5:
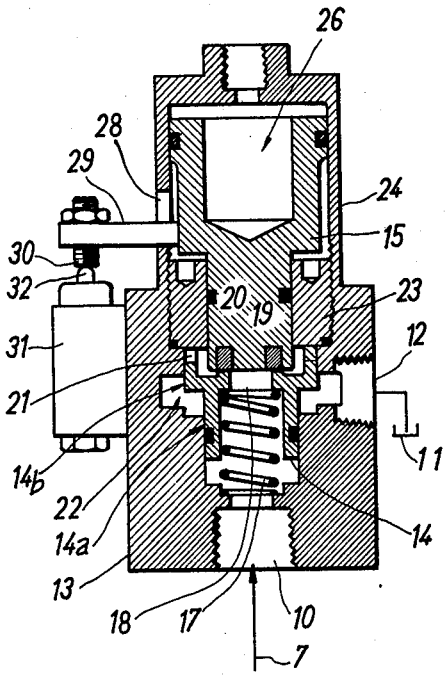
FIG. 5 is a vertical sectional view of a different safety valve embodying the invention, and wherein the means for setting of the relief pressure is a compressed-air cylinder.

The variant embodiment of the foregoing safety valve is shown in FIG. 5. The embodiment shown in the FIG. 5, which also forms a part of the invention, is only different in the means for setting of the relief pressure: The means provided in this embodiment comprises a compressed-air cylinder formed in the cylindrical case 24 and the second member 15 sliding vertically in the case 24, instead of the spring of the foregong embodiment.

The role of the compressed-air cylinder is quite similar to the spring of the foregoing embodiment.

Figure 6:
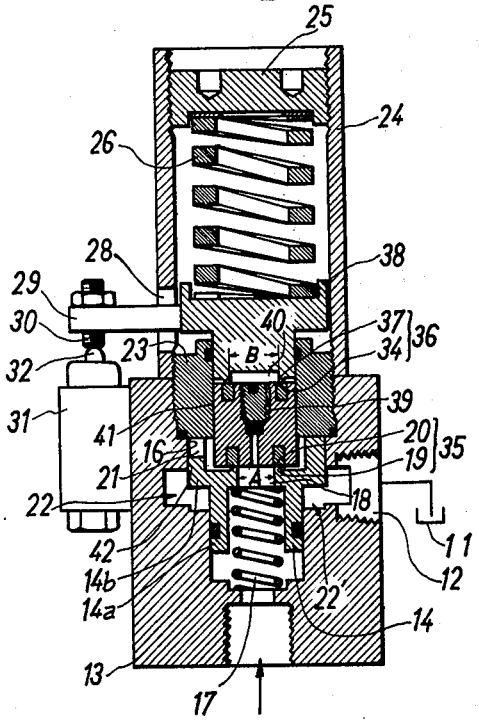
FIG. 6 is a vertical sectional view of another safety valve embodying the invention, and which includes the relief valve part for overload protection and a pressure-temperature compensation valve part.
Figure 8:
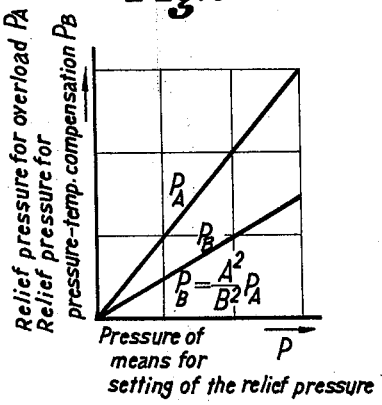
FIG. 8 is a diagram showing the relation among the pressure of means for setting of the relief pressure, the relief pressure of relief valve part for overload, and the relief pressure or the pressure-temperature compensation valve part.

FIG. 6 illustrates another variant embodiment of the first safety valve, which also forms a part of the invention. The object designated by the corresponding reference numbers with the foregoing embodiments are referred to by corresponding name, and function.

The embodiment shown in FIG. 6 is featured by the combination of a pilot operated relief valve part which corresponds to the safety valve described above and a pressure-temperature compensation valve part which may be provided for the overload protector independently of the safety valve in the prior art or in the foregoing embodiments of the present invention.

The featured combination of this embodiment is preferably as follows:

The second member 15, which is inserted in the valve chamber 22 of the valve case 13, is provided with the first valve seat 20 at the bottom facet, and with a second valve seat 34 on the top facet. The first valve seat 20 forms a pilot valve part 35 of the relief valve part with the complementary poppet 19. The second valve seat 34 forms a pressure-temperature compensation valve part 36 with another poppet 37. The second poppet seat 37 is provided at the bottom facet of a piston 38 which slides in the cylindrical case 24 vertically. The piston 38 is urged downward by means for setting of relief pressure, namely, by the spring 26. Spring 17 urges the main valve member 14 and poppet 19 upwardly.

The second member is provided with an orifice 39 which connects the inside parts of both the valve seats 20 and 34 to one another. Thus the fluid is able to flow into the chamber 40, which is formed inside the second poppet 37, through the orifice 39.

The diameter A of the first poppet 19 is dimensioned to be smaller than the diameter B of the second poppet 37. By the differential of the diameters A, the pressure of the fluid which acts on the piston 38 becomes $B^2/A^2$ times the pressure which acts on the second member 15 from the bottom. This causes the initial elevation of the piston 38 by the fluid pressure when the pressure rises slowly due to an increase in temperature: When the pressure of the fluid in the hydraulic passage 7 thus slowly rises above setting pressure $P_B$ for pressure-temperature compensation which is $A^2/B^2$ times of the setting pressure $P_A$ for overload relief, the piston 38 is elevated slightly to open the compensation valve part 36 initially. And when the pressure in the hydraulic passage 7 rises above the setting pressure $P_A$ for overload relief, the second member 15 is elevated to open the pilot valve part 35, and thus to open the whole relief valve part.

There are small gaps, one 41 of which is formed between the second member 15 and the stop 23, and another 42 of which is formed between the large cylindrical part 14*b* of the main valve member 14 and the guide hole 16. So that, the fluid flowing out from the compensation valve part 36, due to a rise in temperature, flows very slowly into the valve chamber 22 through these gaps 41, 42 and slightly relieves pressure in line 7. When the flowage through the compensation valve part 36 is sufficiently effective to drop the pressure in the chamber 40 to a valve below the setting pressure $P_B$, the piston 38 lowers to close the compensation valve part 36 for any slow rise of the fluid pressure above the setting pressure $P_B$ by itself. And the setting pressure $P_A$ of overload relief is automatically set by the setting maneuver for the pressure setting of the compensation valve part 36. Another advantage available from this embodiment is the simplicity of the structure: It is apparent from FIG. 6 that the passage formed in the valve case is quite similar to the foregong embodiments except an orifice 39, a chamber 40, and two gaps 41 and 42.

Figure 7:
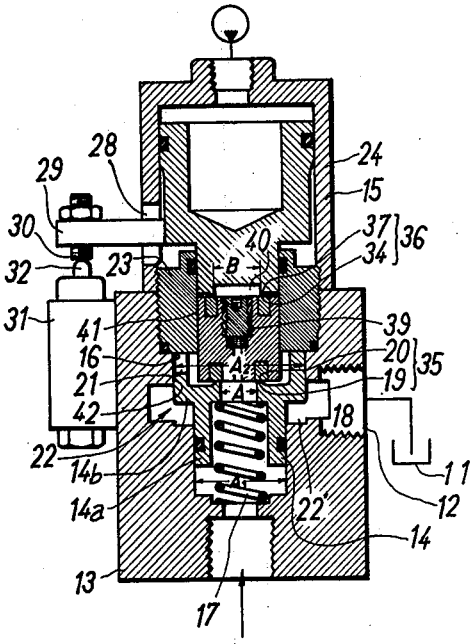
FIG. 7 is a vertical sectional view of the variant embodiment of the safety valve shown in FIG. 6, in which means for setting of the relief pressure is a compressed-air cylinder.

FIG. 7 designates the fourth embodiment of the safety valve which also forms a part of the invention. This embodiment is clearly a combination of the relief valve part which corresponds to the safety valve of the second embodiment aforementioned and a pressure-temperature compensation valve part.

While there is shown and described herein the preferred embodiments of the invention, it is to be understood that the invention is not limited thereto but may be otherwise embodied and practiced within the scope of the following claims.

What is claimed is:

1. In an overload protector for a mechanical press having force transmitting means defined by a piston in a cylinder defining a space therebetween filled with an incompressible fluid and relief valve means for relieving said fluid in response to an overload, the improvement comprising:

a valve body having a bore therein;

a main valve slidable in said bore and having a passageway therethrough; said main valve dividing said bore into upper and lower chambers with the area of said main valve exposed to said upper chamber being greater than the area thereof exposed to said lower chamber;

a fluid connection from said lower chamber to said space and a venting outlet from said upper chamber, said outlet being closed by said main valve when in an upper position and open to said upper chamber where said main valve moves downwardly;

a pilot valve seat around the upper end of said passageway;

a pilot valve moveable downwardly into said upper chamber to engage said seat and close said passageway when said main valve is in said upper position;

yieldable means urging said main valve upwardly; and adjustable yieldable means urging said pilot valve downwardly.

2. An overload protector as defined in claim 1 including further, a restricted flow passage from said passageway to said upper chamber and a yieldable compensator valve normally closing said restricted flow passage whereby to slowly bleed pressure from said lower chamber to said upper chamber in response to pressure increases caused by a rise in temperature.

3. An overload protector as defined in claim 2 wherein said restricted flow passage is defined by an opening through said pilot valve and clearance between said pilot valve and said bore.

4. An overload protector as defined in claim 3 wherein said compensator valve comprises a valve portion at the upper end of said pilot valve and a seat engageable thereby on a slide member in said bore, said slide member being urged downwardly by said adjustable yieldable means.

* * * * *